US008797257B2

(12) United States Patent
Kodama

(10) Patent No.: US 8,797,257 B2
(45) Date of Patent: Aug. 5, 2014

(54) DISPLAY DEVICE HAVING AN IMAGE ERASING CIRCUIT THAT IS INDEPENDENT OF THE DRIVING CIRCUIT AND AN IMAGE ERASING METHOD

(75) Inventor: Yoshiyuki Kodama, Chino (JP)

(73) Assignee: Seiko Epson Corporation (JP)

( * ) Notice: Subject to any disclaimer, the term of this patent is extended or adjusted under 35 U.S.C. 154(b) by 527 days.

(21) Appl. No.: 12/621,734

(22) Filed: Nov. 19, 2009

(65) Prior Publication Data

US 2010/0066717 A1 Mar. 18, 2010

Related U.S. Application Data

(62) Division of application No. 11/074,328, filed on Mar. 4, 2005, now Pat. No. 7,733,324.

(30) Foreign Application Priority Data

Mar. 9, 2004 (JP) ..... 2004-065630

(51) Int. Cl.
*G09G 3/34* (2006.01)

(52) U.S. Cl.
USPC ..... 345/107

(58) Field of Classification Search
CPC ..... G09G 3/3344; G09G 2330/02
USPC ..... 345/107; 359/296
See application file for complete search history.

(56) References Cited

U.S. PATENT DOCUMENTS

| | | | | |
|---|---|---|---|---|
| 6,094,371 | A * | 7/2000 | Fukuda | 365/145 |
| 2002/0005832 | A1 | 1/2002 | Katase | |
| 2002/0033792 | A1 | 3/2002 | Inoue | |
| 2002/0071077 | A1 * | 6/2002 | Namba | 349/117 |
| 2002/0089482 | A1 | 7/2002 | Hanzawa et al. | |
| 2005/0212748 | A1 * | 9/2005 | Matsuura et al. | 345/107 |

FOREIGN PATENT DOCUMENTS

| | | | |
|---|---|---|---|
| JP | 01-195783 | | 8/1989 |
| JP | 11-271707 | | 10/1999 |
| JP | 2002-014379 | | 1/2002 |
| JP | 2002-357853 | | 12/2002 |
| JP | 2003-050565 | | 2/2003 |
| JP | 2003-195831 | | 7/2003 |
| JP | 2004-069965 | * | 3/2004 |

OTHER PUBLICATIONS

International Search Report issued by the Japan Patent Office for the corresponding PCT application No. PCT/JP2005/003613.

* cited by examiner

*Primary Examiner* — Dennis Joseph
(74) *Attorney, Agent, or Firm* — Harness, Dickey & Pierce, P.L.C.

(57) ABSTRACT

A display device including a display layer displaying a black or white color according to an applied voltage, a transparent and non-transparent electrode that are disposed to sandwich the display layer, and a TFT driving circuit capable of applying any given voltage between the pair of electrodes. Also provided is a connection destination switching switch capable of switching the connection destination of the entire transparent electrode to an earth terminal or a connector power source terminal of an external power source connector. With this configuration, a voltage can be applied between the pair of electrodes without using the TFT driving circuit. Accordingly, if the TFT driving circuit fails to operate due to trouble caused by the displaying of information which is not permitted to be shown to others, a voltage can be applied to the display layer so that the displayed information can be erased.

9 Claims, 4 Drawing Sheets

DISPLAY DEVICE HAVING AN IMAGE ERASING CIRCUIT THAT IS INDEPENDENT OF THE DRIVING CIRCUIT AND AN IMAGE ERASING METHOD

This application is a divisional of U.S. patent application Ser. No. 11/074,328 filed on Mar. 4, 2005. This application claims the benefit of Japanese Patent Application No. 2004-065630 filed Mar. 9, 2004. The disclosures of the above applications are incorporated herein by reference.

BACKGROUND OF THE INVENTION

1. Field of the Invention

The present invention relates to a display device which includes a memory type display constituted of a display layer capable of displaying an image by displaying predetermined colors according to an applied voltage and a pair of electrodes disposed so as to sandwich the display layer, and a driving circuit capable of applying a predetermined voltage between the pair of electrodes so that a predetermined image is displayed on the display layer, and to an image erasing method suitable for the display device.

2. Description of the Related Art

Heretofore, as a display device of this type, there has been known, for example, one disclosed in JP2002-357853A, which includes: an electrophoretic display constituted of a display layer having disposed therein multiple microcapsules containing electrophoresis dispersion liquid formed of black charged particles and a white dispersion medium, and a pair of electrodes (transparent electrode and non-transparent electrode) disposed so as to sandwich the display layer; and a driving circuit capable of applying any given voltage between the transparent electrode and non-transparent electrode.

In such a display device, generally, a voltage is applied between the transparent electrode and non-transparent electrode to cause the charged particles of any given microcapsule sandwiched therebetween to be adsorbed to the transparent electrode side so that some information is displayed on the transparent electrode side with the adsorbed charged particles.

Also, when the driving circuit is changed from the state in which the charged particles are adsorbed to the transparent electrode side to the OFF state (release state), the electric charges are retained on both of the electrodes. Thus, the former state is sustained by the Coulomb force of the retained charges. Specifically, with no electrical power applied, the state in which the charged particles are adsorbed is sustained, whereby the information is kept to be displayed on the transparent electrode side.

However, in the conventional display device described above, the information displayed on the transparent electrode side remains displayed until any operation of intentionally erasing the information is performed. Thus, for example, when the driving circuit fails to operate due to a trouble of the display device, the displayed information cannot be erased. In this case, the displayed information may be seen by others.

Especially, when the driving circuit fails to operate during the display of the kind of information which is not permitted to be shown to others, the display device cannot be sent for repair, and cannot be scrapped, either. Consequently, the display layer must be destroyed to prevent the displayed information from being seen by others, thus costing much time and money.

To solve the above unsolved problem of the conventional display devices, an object of the present invention is to provide a display device in which the displayed information can be erased even when the device is in a failed state, and an image erasing method suitable for the display device.

SUMMARY OF THE INVENTION

To achieve the above object, a display device according to the present invention includes: a memory type display constituted of a display layer capable of displaying an image by displaying predetermined colors according to an applied voltage and a pair of electrodes disposed so as to sandwich the display layer; a driving circuit for applying a predetermined voltage between the pair of electrodes so that a predetermined image is displayed on the display layer; and an image erasing circuit for connecting a predetermined power source to one of the pair of electrodes independently from the driving circuit. As an example of the memory type display, there can be listed a display, such as an electrophoretic display, in which the display contents remain displayed even after the power supply is shut off. Also, as an example of the predetermined power source, there can be listed an external power source, a power source for driving the device itself, or the like.

The display layer may be a layer which contains multiple encapsulating areas having encapsulated therein a dispersion medium and charged particles which have colors different from each other.

According to the present invention, there is provided an image erasing method for erasing an image displayed on a memory type display, in which a voltage is applied to the whole of a pair of electrodes disposed so as to sandwich a display layer of the memory type display, independently from a driving circuit which allows the image to be displayed on the memory type display.

With such configuration, a voltage can be applied between the pair of electrodes without using the driving circuit.

Accordingly, for example, even when the driving circuit fails to operate due to a trouble of the device during the display of the kind of information which is not permitted to be shown to others, a voltage can be applied to the display layer so that the displayed information can be erased.

Also, one of the electrodes may be a common electrode shared by the entire display layer, and the image erasing circuit may include a switching section capable of switching the connection destination of the common electrode to one of a terminal for supplying a reference electric potential and a power source terminal of an external power source. As an example of the terminal for supplying a reference electric potential, there can be listed an earth terminal or a terminal for supplying a constant voltage.

With such configuration, in order to display some information, any given voltage can be applied to the display layer by switching the connection destination of the common electrode to the terminal for supplying a reference electric potential and allowing the electric potential of the other electrode to be controlled. Also, in a case where the driving circuit fails to operate and the electric potential of the other electrode is changed to the ground potential, in order to erase the displayed information, the same voltage can be applied to the entire display layer by switching the connection destination of the common electrode to the power source terminal of the external power source.

The one electrode is a common electrode shared by the entire display layer, and the image erasing circuit includes a switching section capable of switching the connection destination of the common electrode to one of a terminal for supplying a reference electric potential and a power source terminal of a driving power source of the self device.

With such configuration, in order to display some information, any given voltage can be applied to the display layer by switching the connection destination of the common electrode to the terminal for supplying the reference electric potential and allowing the electric potential of the other electrode to be controlled. Also, in a case where the driving circuit fails to operate and the electric potential of the other electrode is changed to the ground potential, in order to erase the displayed information, the same voltage can be applied to the entire display layer by switching the connection destination of the common electrode to the power source terminal of the driving power source.

DESCRIPTION OF THE PREFERRED EMBODIMENT

An embodiment of a display device according to the present invention will be described below with reference to the accompanying drawings.

<Configuration of Display Device>

Figure 1:
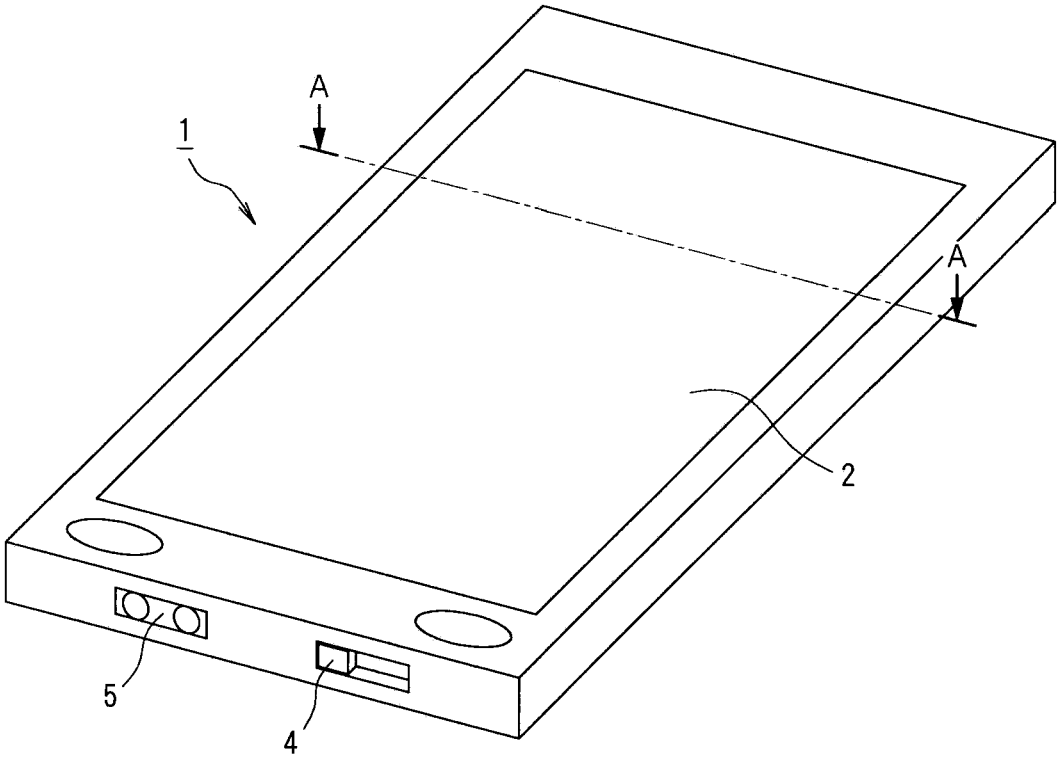
FIG. 1 is a perspective view showing an exterior appearance of a display device according to an embodiment of the present invention.
Figure 2:
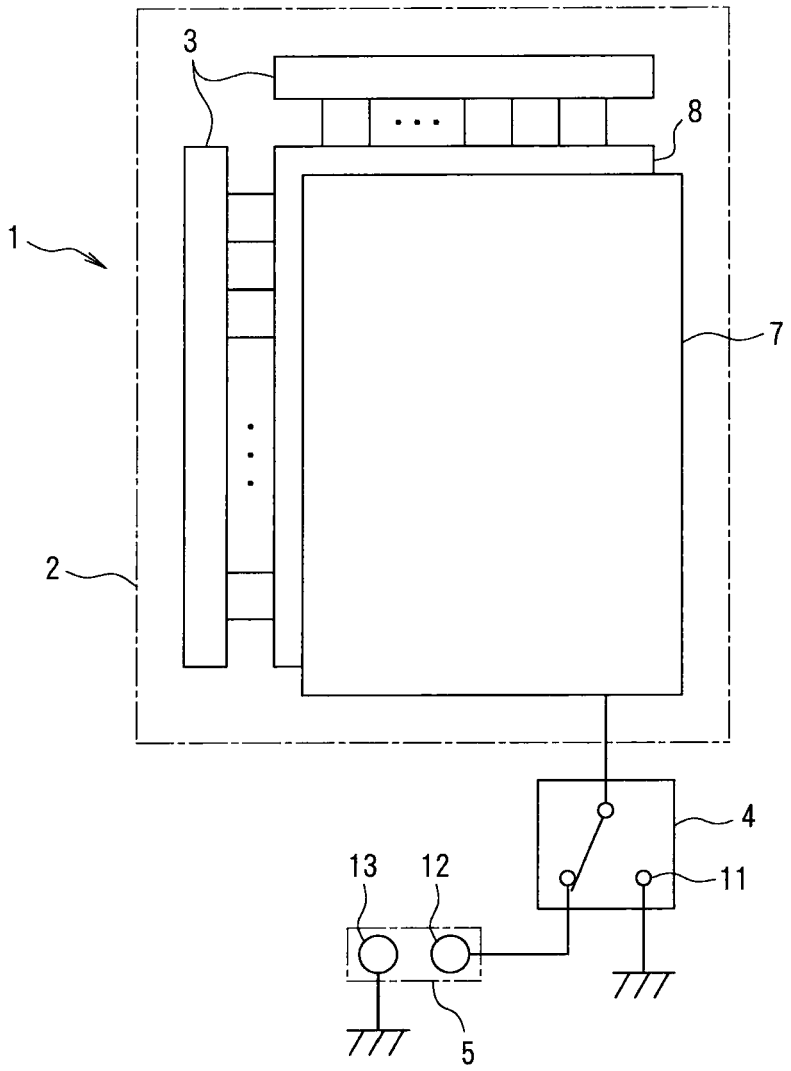
FIG. 2 is a block diagram showing an internal configuration of the display device of FIG. 1.

FIG. 1 is a perspective view showing an exterior appearance of a display device according to the embodiment. FIG. 2 is a block diagram showing an internal configuration of the display device according to the embodiment. As shown in FIG. 1, the display device 1 is constituted by including an electrophoretic display 2, a TFT (Thin Film Transistor) driving circuit 3, a connection destination switching switch 4 and an external power source connector 5.

The electrophoretic display 2 is disposed in the center of the front face of the display device 1, and is constituted by including a display layer 6 and a pair of electrodes 7 and 8.

Figure 3:
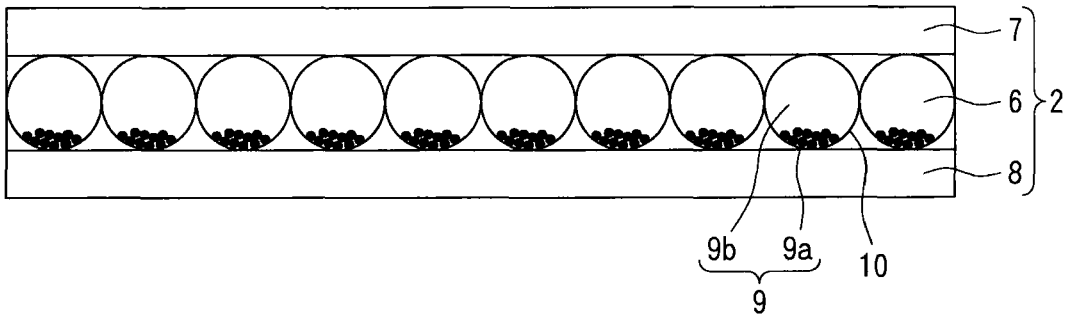
FIG. 3 is a cross-sectional enlarged view showing the gist along the line A-A of FIG. 1.

Among these, as shown in FIG. 3 obtained by breaking the electrophoretic display 2 along the line A-A of FIG. 1, the display layer 6 is a layer having disposed therein multiple microcapsules 10 containing electrophoresis dispersion liquid 9 formed of black negative-charged particles 9*a* and a white dispersion medium 9*b*.

The pair of electrodes 7 and 8 is disposed so as to sandwich the display layer 6, and is formed of a transparent electrode 7 covering the front side and a non-transparent electrode 8 covering the back side. The transparent electrode 7 constitutes a common electrode, and is connected via a connection destination switching switch 4 to one of an earth terminal 11 or a connector power source terminal 12 (described later) of an external power source connector 5. The non-transparent electrode 8 is formed of multiple picture electrodes disposed in a matrix manner; the TFT driving circuit 3 allows each of the picture electrodes to have any given electric potential respectively.

The TFT driving circuit 3 drives the TFT of each picture electrode so that each of the multiple picture electrodes formed in the non-transparent electrode 8 has an electric potential corresponding to the information to be displayed.

The connection destination switching switch 4 is disposed in the right side of the lower end of the display device 1, and is formed of a slide switch capable of sliding right and left. With the connection destination switching switch 4, the transparent electrode 7 of the electrophoretic display 2 is connected to the earth terminal 11 when the switch is operated to slide right; the transparent electrode 7 is connected to the connector power source terminal 12 (described later) of the external power source connector 5 when the switch is operated to slide left. A slide bar of the connection destination switching switch 4 is disposed within a recess outside the housing to prevent the switch 4 from being operated by mistake during the display of information.

Figure 4:
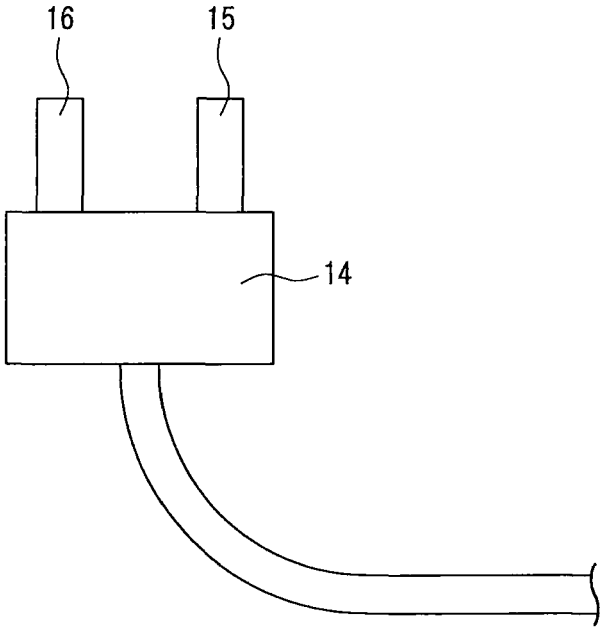
FIG. 4 is an explanatory diagram for explaining a plug for supplying an external power source.

Also, the external power source connector 5 is disposed in the left side of the lower end of the display device 1, and includes the concave connector power source terminal 12 and a connector earth terminal 13 formed in the right and left sides. As shown in FIG. 4, a convex plug power source terminal 15 and plug earth terminal 16 of an external power source supplying plug 14 can be simultaneously inserted into the connector power source terminal 12 and connector earth terminal 13 of the external power source connector 5, respectively. The external power source supplying plug 14 is a plug provided separately from the display device 1, used for supplying an electric potential of +15 V via the connector power source terminal 12 at all times.

<Operation of Display Device>

An operation of the display device 1 according to the embodiment will now be described based on a specific condition.

Firstly, in order to display some information (characters, images, or the like), the connection switching switch 4 is slid to the right side so that the transparent electrode 7 of the electrophoretic display 2 is connected to the earth terminal 11, and then the TFTs of each picture electrode are driven by the TFT driving circuit 3. As a result, a predetermined voltage is applied between the transparent electrode 7 and non-transparent electrode 8, whereby the charged particles 9*a* of any given microcapsules 10 sandwiched between the electrodes 7 and 8 are adsorbed to the transparent electrode 7 side. Thus, predetermined information is displayed by the adsorbed charged particles 9*a* on the transparent electrode 7 side, i.e. on the front side of the electrophoretic display 2.

Suppose that the display device 1 is dropped during the display of some confidential information of a company on the front side of the electrophoretic display 2, whereby the TFT driving circuit 3 is broken. Also, suppose that the TFT driving circuit 3 fails to operate, and the electric potential of the non-transparent electrode 8 is changed to "0", i.e. the ground potential, whereby the displayed information cannot be erased by means of the TFT driving circuit 3. In such case, the connection destination switching switch 4 is slid to the left side so that the transparent electrode 7 of the electrophoretic display 2 is connected to the connector power source terminal 12 of the external power source connector 5. Then, the external power source supplying plug 14 is inserted into the external power source connector 5. At this time, the transparent electrode 7 of the electrophoretic display 2 is electrically connected to the plug power source terminal 15 of the external power source supplying plug 14, whereby the electric potential of the transparent electrode 7 is changed to +15 V, which is larger than the electric potential of the non-transparent electrode 8. Consequently, all the charged particles 9*a* of the microcapsules sandwiched between the electrodes 7 and 8 are adsorbed to the non-transparent electrode 8 side. As a result of the adsorption, the color (white) of the dispersion medium 9*b* is displayed on the transparent electrode 7 side, i.e. on the entire front face side of the electrophoretic display, thereby erasing the confidential information displayed until that time.

In this way, with the display device 1 according to the embodiment, a voltage can be applied between the pair of electrodes 7 and 8 without using the TFT driving circuit 3. Accordingly, even when the TFT driving circuit 3 fails to operate due to a trouble of the device during the display of the kind of information which is not permitted to be shown to others, a voltage can be applied to the display layer 6 so that the displayed information can be erased.

By comparison, with a device in which a voltage between the pair of electrodes 7 and 8 can be applied only by the TFT driving circuit 3, when the TFT driving circuit 3 fails to operate during the display of the kind of information which is not permitted to be shown to others, the display device 1 cannot be sent for repair, and cannot be scrapped, either. Consequently, the display layer 6 must be destroyed to prevent the displayed information from being seen by others, thus costing much time and money.

According to the embodiment, there is described a case where the connection destination switching switch 4 is constituted of a slide switch capable of sliding right and left. However, the connection destination switching switch 4 is not limited thereto, and for example, may be constituted of a sensor for detecting that the external power source supplying plug 14 is inserted into the external power source connector 5. In this case, when it is detected that the external power source supplying plug 14 is inserted, the external power source supplying plug 14 is brought into connection with the connector power source terminal 12 of the external power source connector 5; when it is not detected that the external power source supplying plug 14 is inserted, the transparent electrode 7 of the electrophoretic display 2 is brought into connection with the earth terminal 11. With this method, a trouble of switching the connection destination of the transparent electrode 7 can be saved. In addition, the connection destination can be prevented from being switched by mistake during the display of some information.

Figure 5:
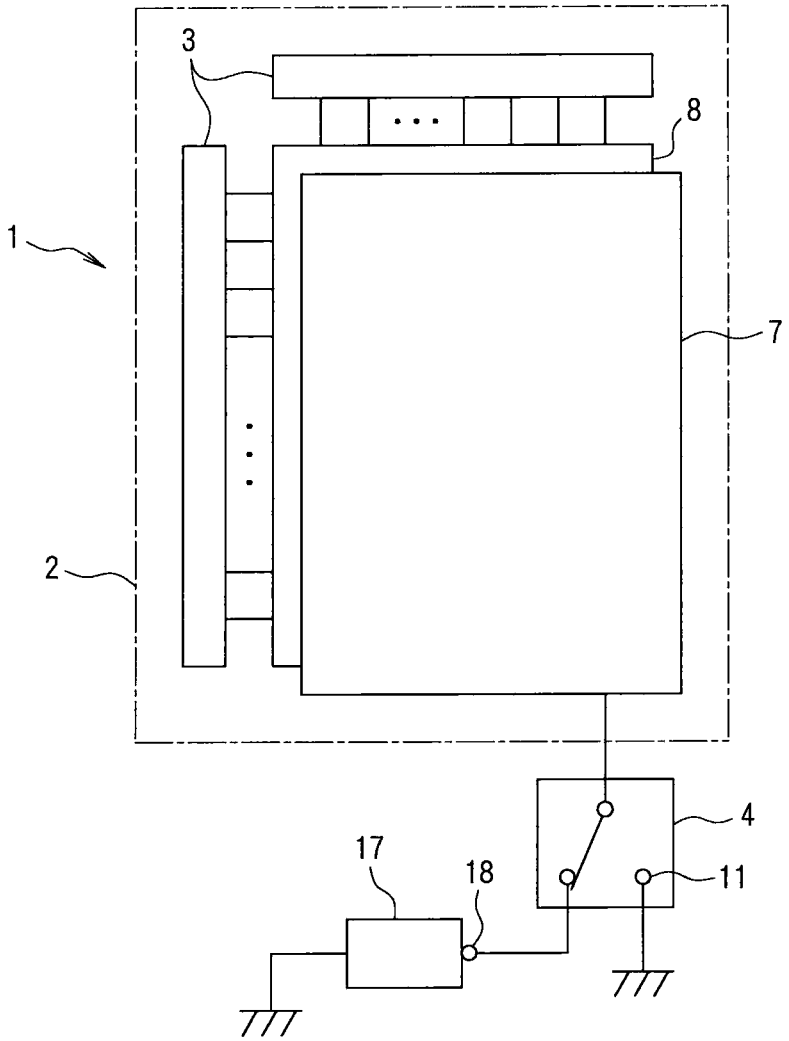
FIG. 5 is an explanatory diagram for explaining a modification of the present invention.

In the above descriptions, the display layer 6 shown in FIGS. 2 and 5 constitutes a display layer described in the claims. Similarly, the transparent electrode 7 and non-transparent electrode 8 shown in FIGS. 2 and 5 constitute electrodes described in the claims; the electrophoretic display 2 shown in FIGS. 1 to 3 and 5 constitutes a memory type display 2; the TFT driving circuit 3 shown in FIGS. 2 and 5 constitutes a driving circuit; the connection destination switching switch 4 and external power source connector 5 shown in FIGS. 2 and 5 constitute an image erasing circuit; and the microcapsule 10 shown in FIG. 3 constitutes an encapsulating area.

Also, the display device and image erasing method according to the present invention are not limited to the description of the above described embodiment, and modifications to the embodiment are possible without departing from the spirit and scope of the invention.

For example, in the above described embodiment, there is described a case where the connection destination of the transparent electrode 7 can be switched to one of the earth terminal 11 and the connector power source terminal 12 of the external power source connector 5. However, the present invention is not limited thereto. For example, the connection destination of the transparent electrode 7 may be switched to a power source terminal 18 of a driving power source 17 of the self device instead of to the connector power source terminal 12 of the external power source connector 5. Specifically, as shown in FIG. 5, the connection switching switch 4 is configured so that the transparent electrode 7 of the electrophoretic display 2 is connected to the earth terminal 11 when the slide bar is slid to the right side, and the transparent electrode 7 is connected to the power source terminal 18 of the driving power source 17 of the self device when the slide bar is slid to the left side. In this case, the driving power source 17 of the self device is a power source for driving each of the circuits, such as the TFT driving circuit 3, in displaying some information.

Also, in the embodiment, there is described a case where information is displayed on the electrophoretic display 2. However, the present invention is not limited thereto. For example, information may be displayed on a display in which charged beads painted partly black, partly white are rotated by applying electricity to allow the black and white colors to be displayed.

The invention claimed is:

1. A display device comprising:

a first electrode;

a plurality of second electrodes;

a non-volatile display layer that displays an image, the non-volatile display layer being disposed between the first electrode and the plurality of second electrodes;

a driving circuit that drives the non-volatile display layer by applying potentials to the plurality of second electrodes to correspond to information of the display image, respectively; and an image erasing circuit including:

a connector that connects the first electrode to an external power source, and a sensor that detects that a plug for supplying the external power source is inserted into the connector, wherein the image erasing circuit erases the displayed image by connecting the first electrode to the external power source through the connector, independent of the driving circuit, when the driving circuit is broken and the displayed image cannot be erased, to make a potential of the first electrode different from the potentials of the plurality of second electrodes, and when the sensor detects that the plug is inserted into the connector, the external power source is electrically connected to the first electrode.

2. The display device according to claim 1, wherein:

the non-volatile display layer continues to display the image even when no electric potential is applied to the first electrode and the plurality of second electrodes.

3. The display device according to claim 1, wherein:

the first electrode is a common electrode; and the plurality of second electrodes are multiple picture electrodes, respectively.

4. The display device according to claim 3, wherein:

an electric potential of the common electrode is greater than electric potentials of the multiple picture electrodes.

5. The display device according to claim 1, wherein:

the non-volatile display layer is an electrophoretic display.

6. The display device according to claim 1, wherein:

the non-volatile display layer includes charged beads that are painted partly black, partly white and that rotate according to applied electric potentials.

7. The display device according to claim 1, wherein when the sensor does not detect that the plug is inserted into the connector, the first electrode is grounded.

8. A method for controlling a non-volatile display device, the method comprising:

driving the non-volatile display device to create an image by controlling voltages applied to a first electrode and a plurality of second electrodes of the non-volatile display device, the non-volatile display layer being disposed between the first electrode and the plurality of second electrodes;

driving the non-volatile display layer by applying potentials to the plurality of second electrodes to correspond to information of the displayed image, respectively;

connecting the first electrode to an external power source through a connector; and detecting that a plug for supplying the external power source is inserted into the connector, wherein the display image is erased by connecting the first electrode to the external power source through the connector in the connecting step, independent of the driving circuit, when the driving circuit is broken and the displayed image cannot be erased, to make a potential of the first electrode different from the potentials of the plurality of second electrodes, and when the detecting step detects that the plug is inserted into the connector, the external power source is electrically connected to the first electrode.

9. The method according claim 8, wherein when the detecting step does not detect that the plug is inserted into the connector, the first electrode is grounded.

* * * * *